US009621992B2

(12) United States Patent
Wang et al.

(10) Patent No.: US 9,621,992 B2
(45) Date of Patent: Apr. 11, 2017

(54) SPEAKER

(71) Applicants: Hongxing Wang, Shenzhen (CN); Lubin Mao, Shenzhen (CN)

(72) Inventors: Hongxing Wang, Shenzhen (CN); Lubin Mao, Shenzhen (CN)

(73) Assignee: AAC ACOUSTIC TECHNOLOGIES (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 14/832,754

(22) Filed: Aug. 21, 2015

(65) Prior Publication Data

US 2016/0198261 A1 Jul. 7, 2016

(30) Foreign Application Priority Data

Jan. 7, 2015 (CN) ..... 2015 2 0010683 U

(51) Int. Cl.
*H04R 25/00* (2006.01)
*H04R 7/18* (2006.01)
*H04R 9/06* (2006.01)

(52) U.S. Cl.
CPC ..... *H04R 7/18* (2013.01); *H04R 9/06* (2013.01); *H04R 2307/207* (2013.01)

(58) Field of Classification Search
CPC ..... H04R 7/20; H04R 2307/207; H04R 7/16; H04R 2307/204; H04R 2207/00; H04R 7/02
USPC ..... 381/398, 396, 403, 420, 421; 181/171–172
See application file for complete search history.

(56) References Cited

U.S. PATENT DOCUMENTS 4,228,327 A * 10/1980 Sawafuji ..... H04R 9/047 381/398
6,075,866 A * 6/2000 Frasl ..... H04R 9/02 181/171
6,178,252 B1 * 1/2001 Frasl ..... H04R 7/12 181/164
2015/0146910 A1 * 5/2015 Beer ..... H04R 7/00 381/398

* cited by examiner

*Primary Examiner* — Davetta W Goins
*Assistant Examiner* — Phylesha Dabney
(74) *Attorney, Agent, or Firm* — Na Xu; IPro, PLLC

(57) ABSTRACT

A speaker is provided in the present disclosure. The speaker includes a magnetic system and a vibrating system placed on the magnetic system, the vibrating system includes a membrane. The membrane comprises a main membrane body and a periphery connected to an outer edge of the main membrane body, the periphery is adjacent to the magnetic system and a ring-shaped structure. The periphery comprises a first connecting portion connected to the main membrane body, a second connecting portion for fixing the membrane, and a middle connecting portion connected between the first connecting portion and the second connecting portion, the middle connecting portion bends perpendicularly to a vibrating direction of the main membrane body.

12 Claims, 3 Drawing Sheets

SPEAKER

FIELD OF THE DISCLOSURE

The present disclosure generally relates to acoustic technologies, and more particularly, to a speaker for producing audible sound.

BACKGROUND

Speakers are widely applied in mobile devices, such as mobile phones, tablet computers or laptop computers, for converting electrical signals into audible sounds. Generally, a speaker includes a vibrating system with a membrane, and the membrane is used for producing audible sounds via vibration. The membrane includes a dome at a central region and a ring-shaped periphery surrounding the dome. The ring-shaped periphery of the membrane includes a protrusion portion which protrudes along a direction parallel to a vibrating direction of the membrane. The protrusion portion is mainly used to provide a recovery stress for the dome during vibration. However, because a protruding direction of the periphery is parallel to a vibrating direction of the membrane, an existence of the periphery may depress an active radiating area of the membrane, and therefore lowers a performance of the speaker.

Therefore, it is desired to provide a new speaker which can overcome the aforesaid problems.

BRIEF DESCRIPTION OF THE DRAWINGS

Many aspects of the embodiment can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and the embodiment thereof.

Figure 1:
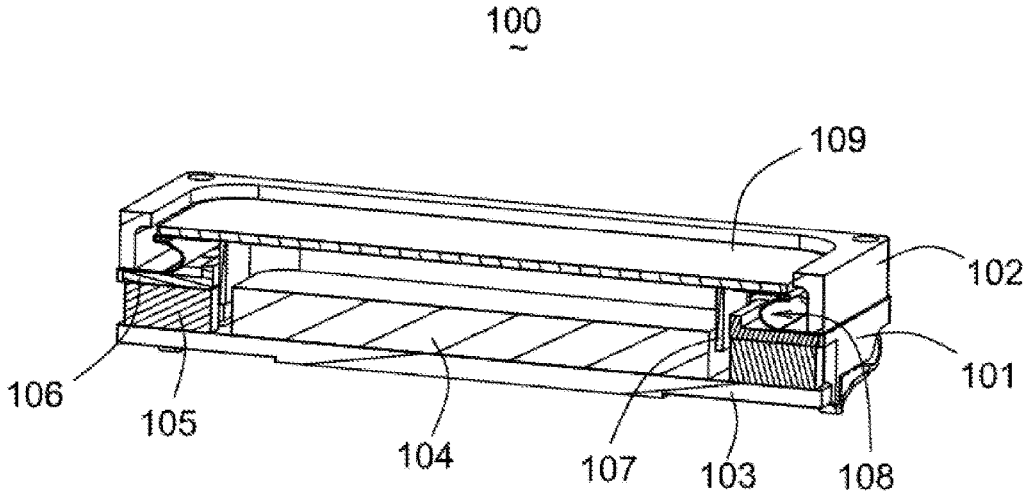
FIG. 1 is a cross-sectional view of a speaker according to an embodiment of the present disclosure.

FIG. 1 is a cross-sectional view of a speaker according to an embodiment of the present disclosure. The speaker 100 includes a holder 101 and a cover 102 connected with the holder 101. The holder 101 and the cover 102 may cooperatively define an accommodating space for receiving a vibrating system and a magnetic system of the speaker 100. The cover 102 includes a sound outlet for outputting audible sound produced by the speaker 100, the sound outlet is typically formed at a main central region of the cover 102.

The magnetic system of the speaker 100 includes a yoke 103, a main magnet unit 104, a secondary magnet unit 105 and a pole plate unit 16. The yoke 103 has a plate shape, and the main magnet unit 104 disposed on a main central region of the yoke 103. The secondary magnet unit 105 is also disposed on the yoke 103, and surrounds the main magnet unit 104. The pole plate unit 106 is disposed on the secondary magnet unit 105.

The vibrating system of the speaker 100 is placed above the magnetic system, and includes a voice coil 107, a membrane 108 and a vibrating plate 109. The vibrating plate 109 is attached to the membrane 108, and faces the sound outlet of the cover 102. The voice coil 107 is disposed under the vibrating plate 109, and is connected with the vibrating plate 109 or the membrane 108.

Figure 2:
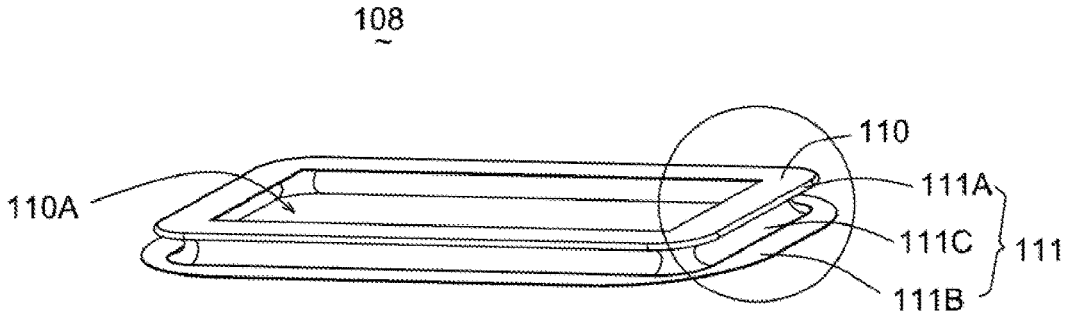
FIG. 2 is a schematic view of a membrane of the speaker in FIG. 1.

Referring also to FIG. 2, the membrane 108 includes a main membrane body 110 and a periphery 111 connected to an outer edge of the main membrane body 110. The main membrane body 110 and the periphery 111 may be formed in a same integrated injection molding process. The main membrane body 110 supports the vibrating plate 109, and the periphery 111 extends from the outer edge of the main membrane body 110.

The periphery 111 is adjacent to the magnetic system of the speaker 100 compared with the main membrane body 110, while the main membrane body 110 is adjacent to the sound outlet of the cover 102. With this configuration, the periphery 111 can have a lower influence on an active radiating area of the main membrane body 110.

In the present embodiment, an opening 110A is formed at a central of the main membrane body 110; the vibrating plate 109 covers the opening 110A and abuts on the main membrane body 110. The periphery 111 has a ring-shaped structure, which includes a first connecting portion 111A, a second connecting portion 111B and a middle connecting portion 111C.

As shown in FIG. 2, the middle connecting portion 111C of the periphery 111 is connected between the first connecting portion 111A and the second connecting portion 111B. The middle connecting portion 111C has an arc-shaped surface which is connected end to end as a ring, the arc-shaped surface bends along a direction perpendicular to a vibrating direction of the main membrane body 110. For example, in the embodiment as illustrated in FIG. 2, the arc-shaped surface bends and protrudes towards a central of the membrane 108. In an alternative embodiment, the arc-shaped surface may also bend and protrude away from central of the membrane 108. Since the middle connecting portion 111C bends perpendicularly to the vibrating direction of the main membrane body 110, the periphery 111 would not occupy a radiating area of the main membrane body 110, and this can effectively improve the active radiating area of membrane 108.

The first connecting portion 111A of the periphery 111 is connected to the main membrane body 110. In the present embodiment, the first connecting portion 111A extends from a top end of the middle connecting portion 111C, and also has an arc-shaped surface. A bending tendency of the arc-shaped surface of the first connecting portion 111A is contrary to that of the middle connecting portion 111C.

The second connecting portion 111B is configured as a fixing element for fixing the membrane 108 within the speaker 100. The second connecting portion 111B has a planar shape, which extends from a bottom end of the middle connecting portion 111C along a direction perpendicular to the vibrating direction of the main membrane body 110.

In the present embodiment, the second connecting portion 111B is placed on a top of the pole plate unit 106, and is pressed by a bottom of the cover 102; that is, the second connecting portion 111B is sandwiched and fixed between the cover 102 and the pole plate unit 106. In another embodiment, the second connecting portion 111B may alternatively be sandwiched and fixed between the bottom of the cover 102 and a top of the holder 101.

Furthermore, the opening 110A of the main membrane body 110 may be greater than the voice coil 107, and in this circumstance, the voice coil 107 can be placed within the middle connecting portion 111C of the periphery 111 and is connected to a bottom of the vibrating plate 109. Alternatively, the opening 110A may also be smaller than the voice coil 107, and in this circumstance the voice coil 107 can be placed around the middle connecting portion 111C of the periphery 111 and is connected to a bottom of the main membrane body 110.

It should be noted that the opening 110A of the main membrane body 110 in the above-described embodiment is an optional element. In other embodiments, the opening 110A can be removed from the main membrane body 110 of the membrane 108.

Figure 3:
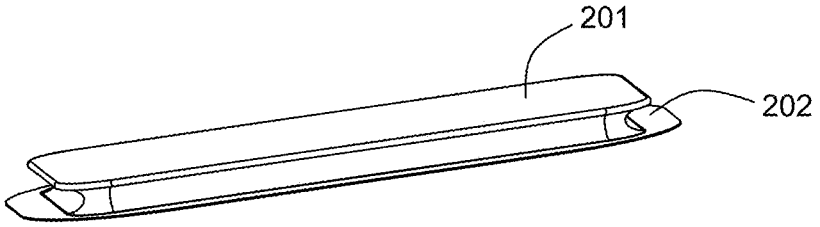
FIG. 3 is a schematic view of a membrane of a speaker according to another embodiment of the present disclosure.
Figure 4:
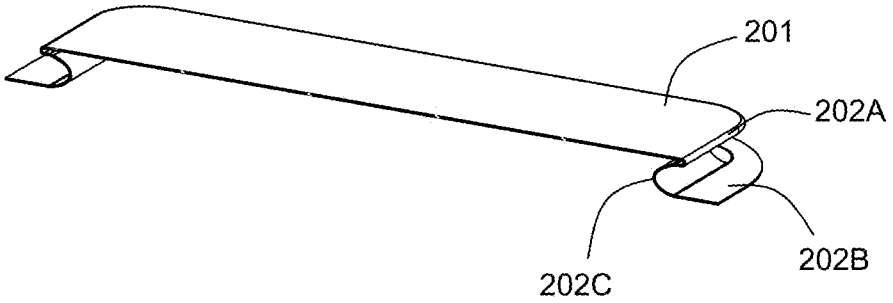
FIG. 4 is a cross-sectional view of the membrane in FIG. 3.
Figure 5:
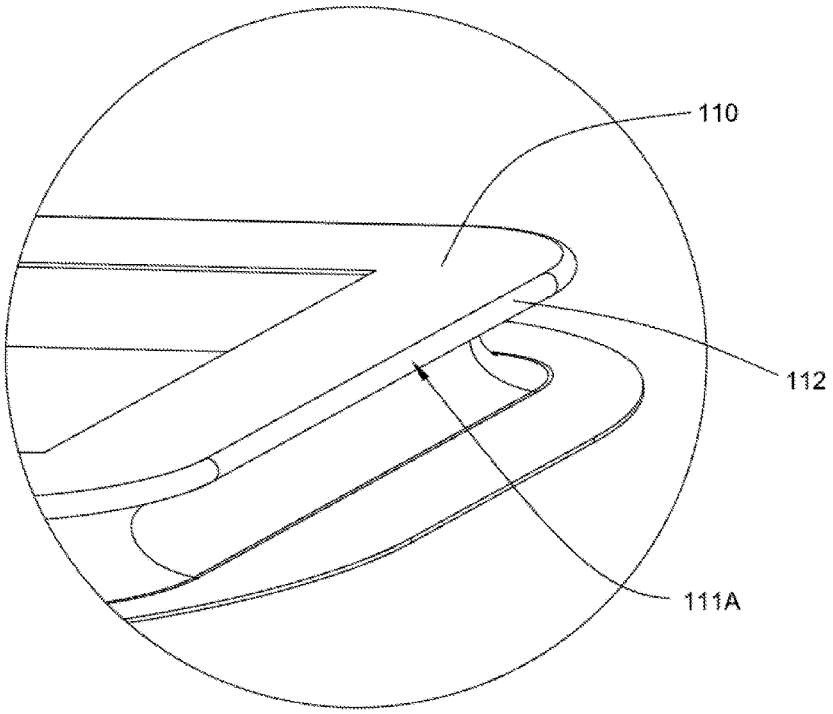
FIG. 5 is an enlarged view of circled part of FIG. 2.

Referring to FIGS. 3-4, a membrane 200 of a speaker according to another embodiment of the present disclosure includes a main membrane body 201 and a periphery 202 connected to an outer edge of the main membrane body 201. The periphery 202 also includes a first connecting portion 202A, a second connecting portion 202B and a middle connecting portion 202C, which are configured in a same manner as the periphery 111 in FIG. 2.

However, differing from the main membrane body 110 in FIG. 2, the main membrane body 201 of the membrane 200 as illustrated in FIG. 2 has a planar shape without any opening. The main membrane body 201 may serve as a vibrating film for producing audible sound via vibration; in other words, a function of the vibrating plate 109 in the speaker 100 in FIG. 1 can be integrated into the main membrane body 201, and thus in the present embodiment, the vibrating plate 109 that might be otherwise needed in the speaker 100 in FIG. 1 can be omitted. Alternatively, when the membrane 200 and the vibrating plate 109 are both used in speaker 100, the main membrane body 201 of the membrane 200 can cooperatively produce audible sound.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a holder;

a cover connected to the holder for forming an accommodating space;

a magnetic system received in the accommodating space; and a vibrating system received in the accommodating space and interacting with the magnetic system, the vibrating system comprising a membrane;

wherein the membrane comprises a main membrane body and a periphery connected to an outer edge of the main membrane body, the periphery is adjacent to the magnetic system and is a ring-shaped structure;

wherein the magnetic system comprises a yoke, a main magnet unit, a secondary magnet unit and a pole plate unit, the main magnet unit is disposed on a main central region of the yoke, the secondary magnet unit is also disposed on the yoke and surrounds the main magnet unit, the pole plate unit is disposed on the secondary magnet unit;

wherein the periphery comprises a first connecting portion connected to the main membrane body, a second connecting portion for fixing the membrane, and a middle connecting portion connected between the first connecting portion and the second connecting portion, the middle connecting portion bends perpendicularly to a vibrating direction of the main membrane body.

2. The speaker of claim 1, wherein the middle connecting portion has an arc-shaped surface bending towards a central of the membrane.

3. The speaker of claim 2, wherein the second connecting portion has a planar shape, and extends from a bottom end of the middle connecting portion along a direction perpendicular to the vibrating direction of the main membrane body.

4. The speaker of claim 3, wherein the first connecting portion extends from a top end of the middle connecting portion, and comprises an arc-shaped surface bending in a direction contrary to that of the middle connecting portion.

5. The speaker of claim 1, wherein an opening is formed at a central of the main membrane body.

6. The speaker of claim 5, wherein the vibrating system further comprises a vibrating plate attached to the main membrane body and covering the opening of the main membrane body.

7. The speaker of claim 5, wherein the vibrating system further comprises a voice coil disposed under the vibrating plate.

8. The speaker of claim 7, wherein the opening is greater than the voice coil, and the voice coil is placed within the middle connecting portion of the periphery and is connected to a bottom of the vibrating plate.

9. The speaker of claim 1, wherein the main membrane body has a planar shape without any opening forming thereon, the main membrane body serves as a vibrating film for producing audible sound via vibration.

10. The speaker of claim 1, wherein the second connecting portion is sandwiched and fixed between the cover and the pole plate unit of the magnetic system.

11. The speaker of claim 1, wherein the second connecting portion is sandwiched and fixed between the cover and the holder.

12. The speaker of claim 1, wherein the main membrane body and the periphery of the membrane is formed in a same integrated injection molding process.

* * * * *